US006730005B1

(12) United States Patent
Liao

(10) Patent No.: US 6,730,005 B1
(45) Date of Patent: May 4, 2004

(54) BALL POSITIONING STRUCTURE

(75) Inventor: Jim Liao, Hsin Chu Hsien (TW)

(73) Assignee: Hsin Lung Accessories Co., Ltd., Hsin Chu Hsien (TW)

( * ) Notice: Subject to any disclaimer, the term of this patent is extended or adjusted under 35 U.S.C. 154(b) by 0 days.

(21) Appl. No.: 10/329,524

(22) Filed: Dec. 27, 2002

(51) Int. Cl.[7] ..... A63B 26/00

(52) U.S. Cl. ..... 482/142; 482/146; 482/147; 482/79; 482/80; 482/77; 482/75; 446/220; 273/58 R

(58) Field of Search ..... 482/142, 146, 482/147, 79, 80, 77, 75; 446/220; 273/58 R

(56) References Cited

U.S. PATENT DOCUMENTS 4,291,873 A * 9/1981 Lee et al. ..... 272/146

* cited by examiner

*Primary Examiner*—Nicholas D. Lucchesi
*Assistant Examiner*—L Amerson
(74) *Attorney, Agent, or Firm*—Troxell Law Office PLLC

(57) ABSTRACT

A ball positioning structure on which a ball is placed comprises a lower body including a round disk with a through-hole in the center thereof, an upper body covered on the lower body and having a bore provided in the center thereof which is in alignment with the through-hole; a bearing disposed in the bore of the upper body such that the upper body and the slide device are mutually rotatable, and a frame, on which a ball is placed, disposed on the surface of the upper body. A user may sit on the ball, press the ball, or lean on the ball and make fixed-point rotation to enhance enjoyment of playing.

1 Claim, 4 Drawing Sheets

BALL POSITIONING STRUCTURE

BACKGROUND OF THE INVENTION

1. Field of the Invention

The present invention relates to a positioning structure, in particular to a ball positioning structure for positioning a ball thereon, in which the positioning structure may be rotated so as to make playing with the ball more interesting and enjoyable.

2. Description of the Related Art

With reference first to FIG. 1 which shows a perspective view of the conventional ball positioning structure, it can be noted that the structure shown includes a base 1 and a frame 2, in which the frame 2 is fixed on the base 1 for placing a ball 3 thereon, such that a user can bend over and lean on the upper portion of the ball with an up-and-down rocking motion or use his two hands to press the ball. Although the ball is fixed in position and will not roll off, the base 1 can not rotate in itself and, thus, the interesting quality of playing with the ball is diminished.

SUMMARY OF THE INVENTION

Accordingly, an object of the present invention is to provide a ball positioning structure which can accommodate the user to perform rotation by sitting on the ball, pressing the ball or leaning on the ball to improve the interesting quality and enjoyment of playing.

To achieve the above object, the present invention provides a ball positioning structure comprising:

a lower body including a disk having a through-hole in the center thereof, an upper body covered on said lower body having a bore at the center thereof which is in alignment and joined with said, through-hole;

a slide device provided in said bore of said upper body such that said upper body and said slide device are mutually rotatable; and a frame provided on the surface of said upper body.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
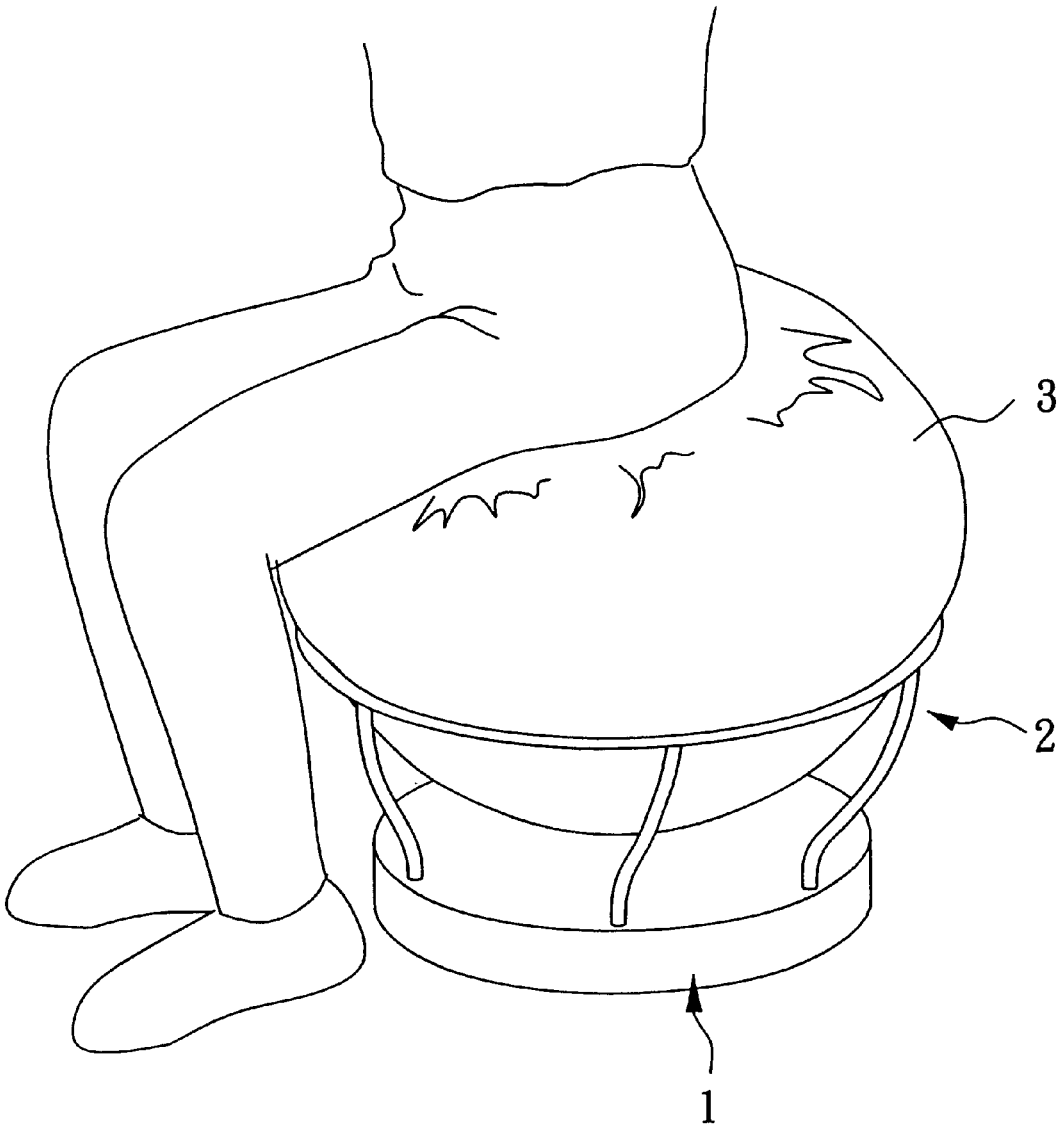
FIG. 1 (PRIOR ART)
FIG. 1 is a schematic view of the conventional ball positioning structure.
Figure 2:
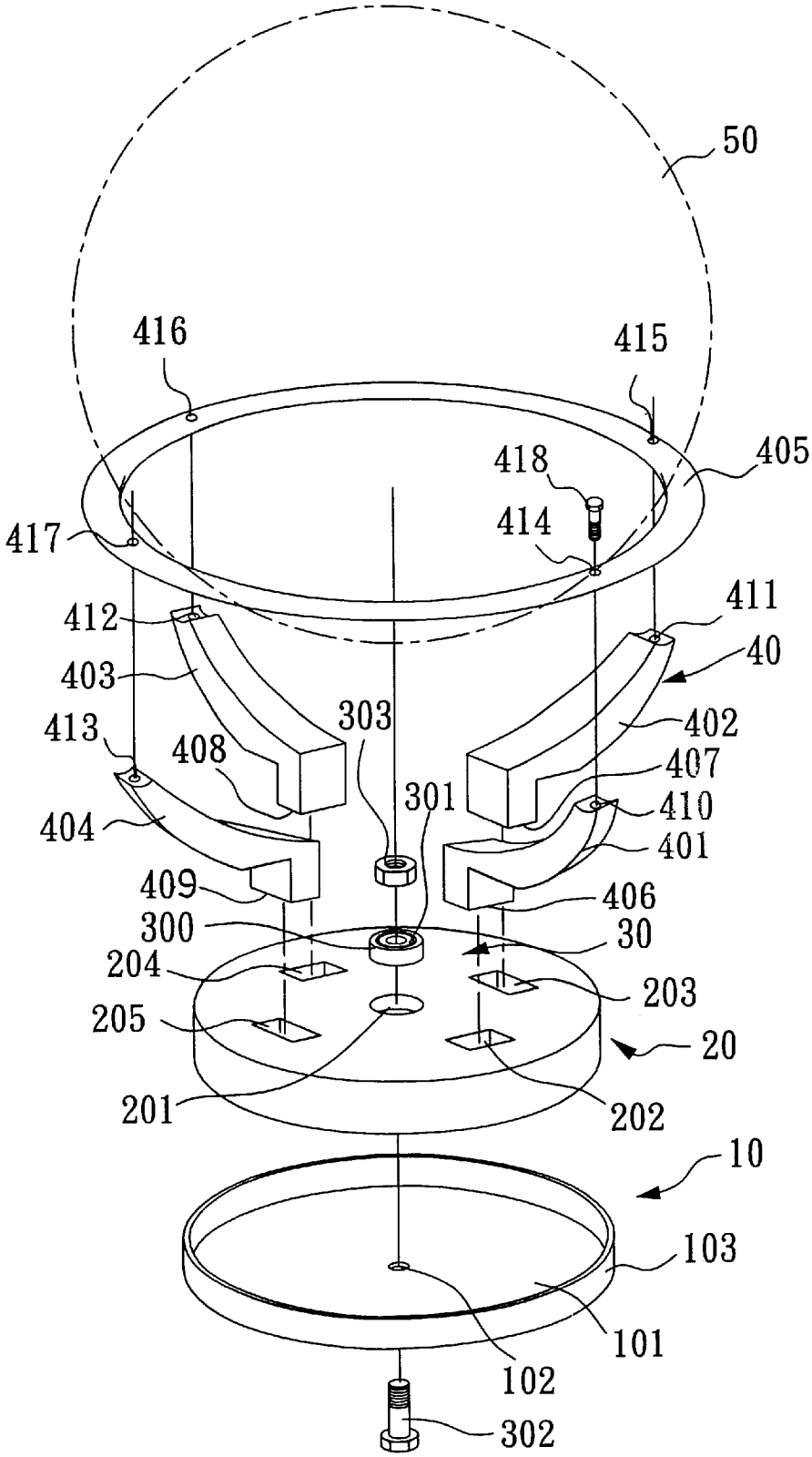
FIG. 2 is an exploded perspective view of the present invention.
Figure 3:
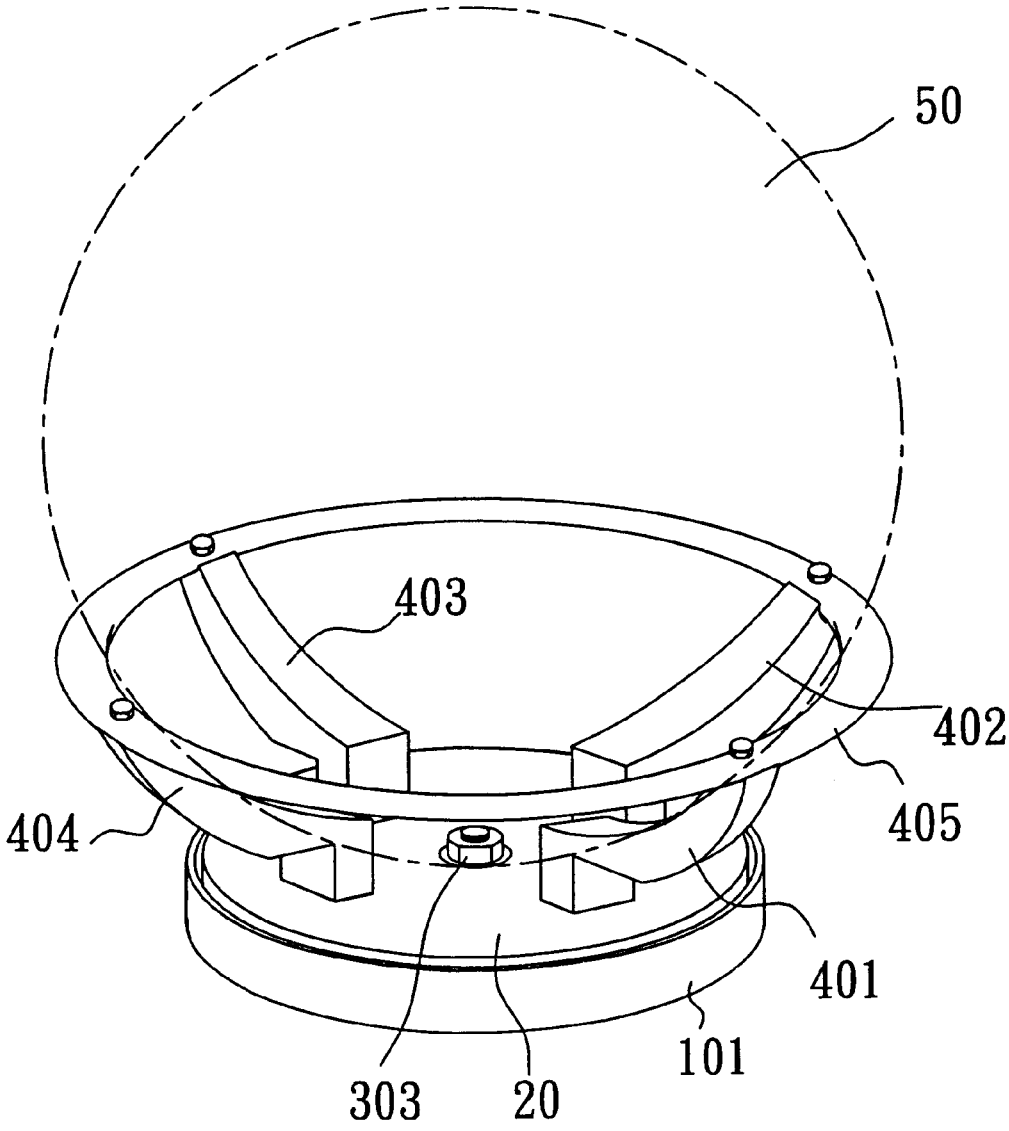
FIG. 3 shows the assembled form of the present invention.

With reference to FIG. 2 in conjunction with FIG. 3, the present invention, according to a preferred embodiment, comprises a lower body 10, an upper body 20 covered on the lower body 10, a slide device 30 provided on the center of the upper body (20), and a frame 40 disposed on the surface of the upper body 20.

The lower body 10 includes a round disk 101, the disk 101 having a through-hole 102 in the center thereof and a raised rim 103 around the periphery thereof.

The upper body 20 is similarly of rounded shape consistent with the shape of the lower body 10, with a bore 201 provided in the center thereof. On the surface are disposed a plurality of groove holes. In the present embodiment, four of such holes, 202,203,204,205 are illustrated.

The slide device 30 is a bearing 300 disposed within the bore 201 of the upper body 20 such that the upper body 20 and bearing 300 are mutually rotatable. The center of bearing 300 is an opening 301. A bolt 302 is passed through the through-hole 102 of the lower body 10 and the opening 301 of the bearing 300, and is then locked with a nut 303, allowing the upper body 20, when applied with a rotation force, to rotate on the surface of the lower body 10.

The frame 40 includes four supports 401,402,403,404 and a circular frame 405 on which a ball 50 is placed. The supports 401,402,403,404 are all of arcuate shape and the respective bottom ends 406,407,408,409 thereof are inserted in the groove holes 202,203,204,205, respectively, of the upper body 20. The top ends of the supports are each provided with a threaded hole 410,411,412,413. The circular frame 405 is provided with four apertures 414,415,416,417 which are aligned with the threaded holes 410,411,412,413 and then locked with screws 418, respectively.

Figure 4:
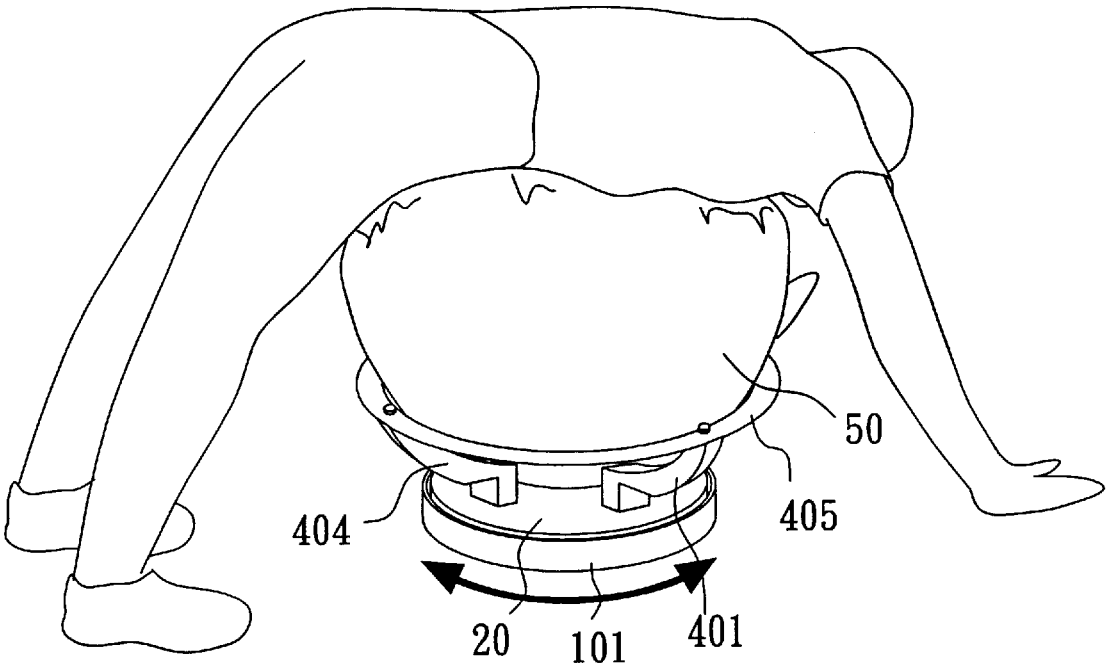
FIG. 4 is a schematic view of the present invention in use.

With reference to FIG. 4, a user can sit on the ball 50 and make up and down movement or bend over to lean on the ball 50 and make rotary movement, to thereby enhance the enjoyment of playing with the ball.

While the present invention has been described in connection with what is considered the most practical and preferred embodiment, it is understood that this invention-is not limited to the disclosed embodiment but is intended to cover various arrangements included within the spirit and scope of the broadest interpretation so as to encompass all such modifications and equivalent arrangements.

What is claimed is:

1. A ball positioning structure comprising:

a) a lower body including a disk having a through hole in a center thereof;

b) an upper body located on said lower body and having:

i) a bore in a center thereof which is in alignment and joined with said through hole; and ii) a plurality of groove holes located therein;

c) a slide device located between and rotatably connecting said lower body and said upper body; and d) a frame including a plurality of supports, each of the plurality of supports fixedly inserted in one of the plurality of groove holes, the frame configured to support a ball thereon for a user to sit on the ball and move up and down and bend over to lean on the ball and make rotary movements.

* * * * *